US005774836A

United States Patent [19]

Bartkowiak et al.

[11] Patent Number: 5,774,836

[45] Date of Patent: Jun. 30, 1998

[54] SYSTEM AND METHOD FOR PERFORMING PITCH ESTIMATION AND ERROR CHECKING ON LOW ESTIMATED PITCH VALUES IN A CORRELATION BASED PITCH ESTIMATOR

[75] Inventors: John G. Bartkowiak; Mark Ireton, both of Austin, Tex.

[73] Assignee: Advanced Micro Devices, Inc., Sunnyvale, Calif.

[21] Appl. No.: 626,728

[22] Filed: Apr. 1, 1996

[51] Int. Cl.[6] ..... G10L 3/02; G10L 9/00

[52] U.S. Cl. ..... 704/207; 704/216

[58] Field of Search ..... 395/2.14, 2.16, 395/217–218, 2.2, 2.23, 2.25, 2.26, 2.28

[56] References Cited

U.S. PATENT DOCUMENTS

| | | | |
|---|---|---|---|
| 3,649,765 | 3/1972 | Rabiner et al. | 395/2.18 |
| 3,979,557 | 9/1976 | Schulman et al. | 395/2.16 |
| 4,544,919 | 10/1985 | Gerson . | |
| 4,561,102 | 12/1985 | Prezas | 395/2.16 |
| 4,696,038 | 9/1987 | Doddington et al. | 395/2.16 |
| 4,731,846 | 3/1988 | Secrest et al. | 395/2.16 |
| 4,817,157 | 3/1989 | Gerson . | |
| 4,896,361 | 1/1990 | Gerson . | |
| 5,195,166 | 3/1993 | Hardwick et al. | 395/2.09 |
| 5,353,372 | 10/1994 | Cook et al. | 395/2.16 |
| 5,473,727 | 12/1995 | Nishiguchi et al. | 395/2.31 |

OTHER PUBLICATIONS

Aldo Cumani, "On A Covariance–Lattice Algorithm For Linear Prediction," ICASSP 82 Proceedings, May 3, 4, 5, 1982, Palais Des Congres, Paris, France, vol. 2 of 3, IEEE International Conference on Acoustics, Speech and Signal Processing, pp. 651–654.

Hirose, et al; "A S cheme for Pitch Extraction of Speech Using Autocorrelation Function with Frame Length Proportional to the Time lag" ICASSP 92, vol. 1 pp. I–149–I–152.

McAuley et al; "Pitch Estimation and Voicing Detection Based On A Sinusoidal Model" ICASSP 90, pp. 249–252.

Atkinson, et al; "Pitch detection os speech signals using segmented autocorrelation" Electronics Letters Mar., 1995, vol. 31, pp. 533–535.

*Primary Examiner*—Allen R. McDonald
*Assistant Examiner*—Patrick N. Eduoard
*Attorney, Agent, or Firm*—Conley, Rose & Tayon; Jeffrey C. Hood

[57] ABSTRACT

An improved vocoder system and method for estimating pitch in a speech waveform which more accurately disregards false pitch estimates resulting from secondary excitations. The vocoder system first performs a correlation calculation on a speech frame and generates an estimated pitch value. The present invention then compares the estimated or determined pitch with a threshold value to determine if the determined or estimated pitch has a suspiciously low pitch value. If so, the present invention performs error checking to disregard pitch estimates that are the result of the First Formant frequency's contribution to the pitch estimation process. The error checking involves examining the higher multiples of the determined pitch value to ascertain whether the determined pitch value might be incorrect. The present invention determines whether one or more higher multiples are missing, whether the higher multiples are related by a common factor, and whether adjacent multiples have missing peaks. The error checking also involves searching for missing or low correlation peaks in the neighborhood of missing higher multiples of the determined pitch. If the error checking indicates that the determined pitch is probably incorrect, then a new determination is made without the correlation peak corresponding to the rejected determined pitch. This provides a more accurate pitch estimation, thus enhancing voice storage quality. The present invention thus comprises an improved correlation method for estimating the pitch parameter which more accurately disregards false correlation peaks resulting from secondary excitations, including the contribution of the First Formant.

19 Claims, 11 Drawing Sheets

Representation of Speech Signals

Range of bit rates for various types of speech representations.

Source-system model of speech production

General discrete-time model for speech production

Block diagram of simplified model for speech production

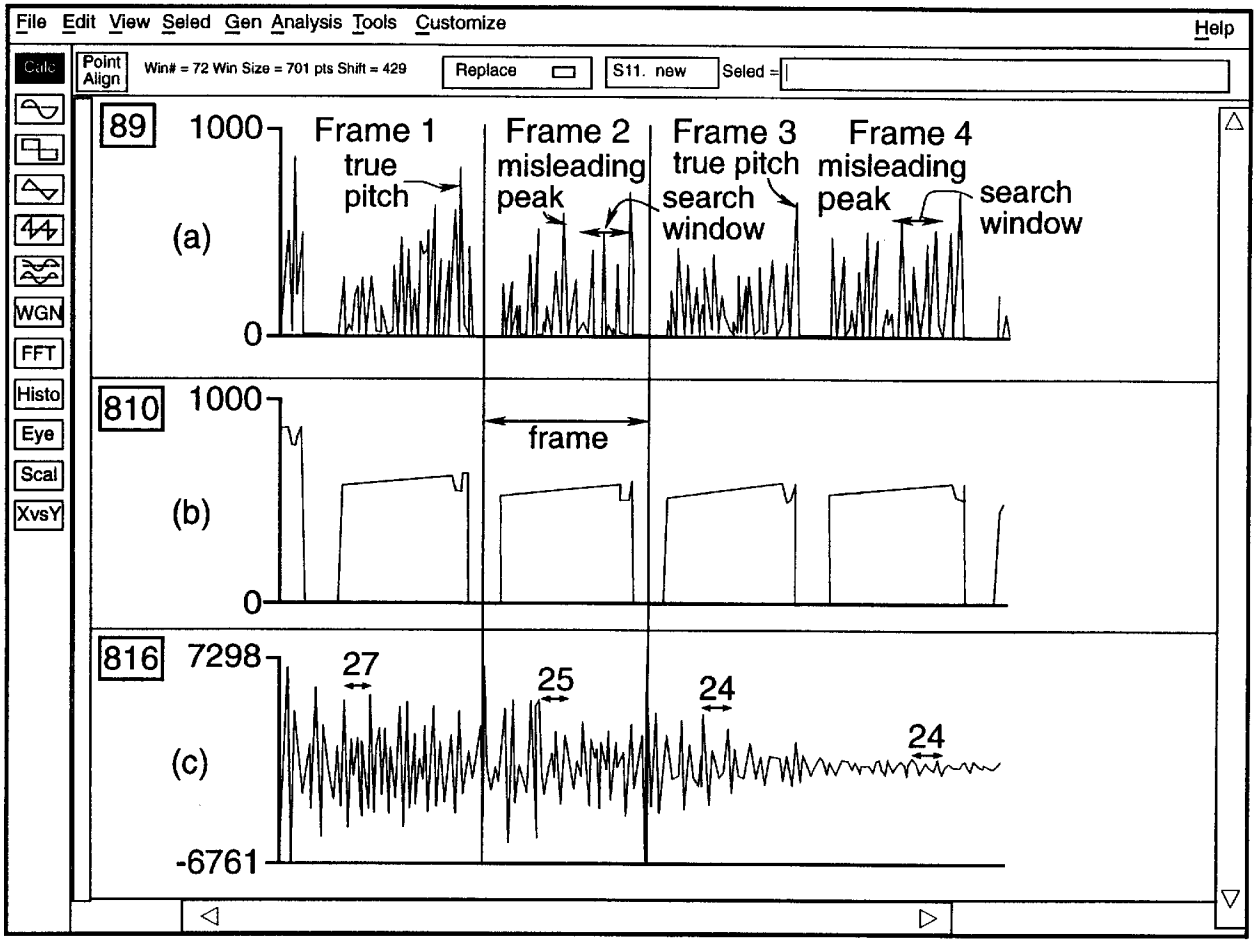
Missing Pitch Peak Checking Method
Fig. 10: (a) Speech Frames Under Analysis
(b) Correlation Threshold Values
(c) Frame Correlation Values

SYSTEM AND METHOD FOR PERFORMING PITCH ESTIMATION AND ERROR CHECKING ON LOW ESTIMATED PITCH VALUES IN A CORRELATION BASED PITCH ESTIMATOR

FIELD OF THE INVENTION

The present invention relates generally to a vocoder which receives speech waveforms and generates a parametric representation of the speech waveforms, and more particularly to an improved vocoder system and method for pitch error checking in a correlation-based pitch estimator.

DESCRIPTION OF RELATED ART

Digital storage and communication of voice or speech signals has become increasingly prevalent in modern society. Digital storage of speech signals comprises generating a digital representation of the speech signals and then storing those digital representations in memory. As shown in FIG. 1, a digital representation of speech signals can generally be either a waveform representation or a parametric representation. A waveform representation of speech signals comprises preserving the "waveshape" of the analog speech signal through a sampling and quantization process. A parametric representation of speech signals involves representing the speech signal as a plurality of parameters which affect the output of a model for speech production. A parametric representation of speech signals is accomplished by first generating a digital waveform representation using speech signal sampling and quantization and then further processing the digital waveform to obtain parameters of the model for speech production. The parameters of this model are generally classified as either excitation parameters, which are related to the source of the speech sounds, or vocal tract response parameters, which are related to the individual speech sounds.

FIG. 2 illustrates a comparison of the waveform and parametric representations of speech signals according to the data transfer rate required. As shown, parametric representations of speech signals require a lower data rate, or number of bits per second, than waveform representations. A waveform representation requires from 15,000 to 200,000 bits per second to represent and/or transfer typical speech, depending on the type of quantization and modulation used. A parametric representation requires a significantly lower number of bits per second, generally from 500 to 15,000 bits per second. In general, a parametric representation is a form of speech signal compression which uses a priori knowledge of the characteristics of the speech signal in the form of a speech production model. A parametric representation represents speech signals in the form of a plurality of parameters which affect the output of the speech production model, wherein the speech production model is a model based on human speech production anatomy.

Speech sounds can generally be classified into three distinct classes according to their mode of excitation. Voiced sounds are sounds produced by vibration or oscillation of the human vocal cords, thereby producing quasi-periodic pulses of air which excite the vocal tract. Unvoiced sounds are generated by forming a constriction at some point in the vocal tract, typically near the end of the vocal tract at the mouth, and forcing air through the constriction at a sufficient velocity to produce turbulence. This creates a broad spectrum noise source which excites the vocal tract. Plosive sounds result from creating pressure behind a closure in the vocal tract, typically at the mouth, and then abruptly releasing the air.

A speech production model can generally be partitioned into three phases comprising vibration or sound generation within the glottal system, propagation of the vibrations or sound through the vocal tract, and radiation of the sound at the mouth and to a lesser extent through the nose. FIG. 3 illustrates a simplified model of speech production which includes an excitation generator for sound excitation or generation and a time varying linear system which models propagation of sound through the vocal tract and radiation of the sound at the mouth. Therefore, this model separates the excitation features of sound production from the vocal tract and radiation features. The excitation generator creates a signal comprised of either a train of glottal pulses or randomly varying noise. The train of glottal pulses models voiced sounds, and the randomly varying noise models unvoiced sounds. The linear time-varying system models the various effects on the sound within the vocal tract. This speech production model receives a plurality of parameters which affect operation of the excitation generator and the time-varying linear system to compute an output speech waveform corresponding to the received parameters.

Referring now to FIG. 4, a more detailed speech production model is shown. As shown, this model includes an impulse train generator for generating an impulse train corresponding to voiced sounds and a random noise generator for generating random noise corresponding to unvoiced sounds. One parameter in the speech production model is the pitch period, which is supplied to the impulse train generator to generate the proper pitch or frequency of the signals in the impulse train. The impulse train is provided to a glottal pulse model block which models the glottal system. The output from the glottal pulse model block is multiplied by an amplitude parameter and provided through a voiced/unvoiced switch to a vocal tract model block. The random noise output from the random noise generator is multiplied by an amplitude parameter and is provided through the voiced/unvoiced switch to the vocal tract model block. The voiced/unvoiced switch is controlled by a parameter which directs the speech production model to switch between voiced and unvoiced excitation generators, i.e., the impulse train generator and the random noise generator, to model the changing mode of excitation for voiced and unvoiced sounds.

The vocal tract model block generally relates the volume velocity of the speech signals at the source to the volume velocity of the speech signals at the lips. The vocal tract model block receives various vocal tract parameters which represent how speech signals are affected within the vocal tract. These parameters include various resonant and unresonant frequencies, referred to as formants, of the speech which correspond to poles or zeroes of the transfer function V(z). The output of the vocal tract model block is provided to a radiation model which models the effect of pressure at the lips on the speech signals. Therefore, FIG. 4 illustrates a general discrete time model for speech production. The various parameters, including pitch, voice/unvoice, amplitude or gain, and the vocal tract parameters affect the operation of the speech production model to produce or recreate the appropriate speech waveforms.

Referring now to FIG. 5, in some cases it is desirable to combine the glottal pulse, radiation and vocal tract model blocks into a single transfer function. This single transfer function is represented in FIG. 5 by the time-varying digital filter block. As shown, an impulse train generator and random noise generator each provide outputs to a voiced/unvoiced switch. The output from the switch is provided to a gain multiplier which in turn provides an output to the time-varying digital filter. The time-varying digital filter performs the operations of the glottal pulse model block, vocal tract model block and radiation model block shown in FIG. 4.

One key aspect for generating a parametric representation of speech from a received waveform involves accurately estimating the pitch of the received waveform. The estimated pitch parameter is used later in re-generating the speech waveform from the stored parameters. For example, in generating speech waveforms from a parametric representation, a vocoder generates an impulse train comprising a series of periodic impulses separated in time by a period which corresponds to the pitch frequency of the speaker. Thus, when creating a parametric representation of speech, it is important to accurately estimate the pitch parameter. It is noted that, for an all digital system, the pitch parameter is restricted to be some multiple of the sampling interval of the system.

The estimation of pitch in speech using time domain correlation methods has been widely employed in speech compression technology. Time domain correlation is a measurement of similarity between two functions. In pitch estimation, time domain correlation measures the similarity of two sequences or frames of digital speech signals sampled at 8 KHz, as shown in FIG. 6. In a typical vocoder, 160 sample frames are used where the center of the frame is used as a reference point. As shown in FIG. 6, if a defined number of samples to the left of the point marked "center of frame" are similar to a similarly defined number of samples to the right of this point, then a relatively high correlation value is produced. Thus, detection of periodicity is possible using the so called correlation coefficient, which is defined as:

$$corcoef = \frac{\sum_{n=0}^{N-1} [x(n) - \bar{x}][x(n-d) - \overline{xd}]}{\sqrt{\sum_{n=0}^{N-1} [x(n) - \bar{x}]^2} * \sqrt{\sum_{n=0}^{N-1} [x(n-d) - \overline{xd}]^2}} \quad \text{Eqn (1)}$$

$$\text{where } \bar{x} = \frac{1}{N} \sum_{n=0}^{N-1} [x(n)] \text{ and } \overline{x(d)} = \frac{1}{N} \sum_{n=0}^{N-1} [x(n-d)] \quad \text{Eqn's (2)\&(3)}$$

The x(n−d) samples are to the left of the center point and the x(n) samples lie to the right of the center point. This function indicates the closeness to which the signal x(n) matches an earlier-in-time version of the signal x(n−d). This function displays the property that abs[corcoef]<=1. Also, if the function is equal to 1, x(n)=x(n−d) for all n.

When the delay d becomes equal to the pitch period of the speech under analysis, the correlation coefficient, corcoef, becomes maximum. For example, if the pitch is 57 samples, then the correlation coefficient will be high or maximum over a range of 57 samples. In general, pitch periods for speech lie in the range of 21–147 samples at 8 KHz. Thus, correlation calculations are performed for a number of samples N which varies between 21 and 147 in order to calculate the correlation coefficient for all possible pitch periods.

It is noted that a high value for the correlation coefficient will register at multiples of the pitch period, i.e., at 2 and 3 times the pitch period, producing multiple peaks in the correlation. In general, to remove extraneous peaks caused by secondary excitations, which are very common in voiced segments, the correlation function is clipped using a threshold function. Logic is then applied to the remaining peaks to determine the actual pitch of that segment of speech. These types of technique are commonly used as the basis for pitch estimation.

Correlation-based techniques generally have limitations in accurately estimating the pitch parameter under all conditions. In order to accurately estimate the pitch parameter, it is important to mitigate the effects of extraneous and misleading signal information which can confuse the estimation method. In particular, in speech which is not totally voiced, or contains secondary excitations in addition to the main pitch frequency, the correlation-based methods can produce misleading results. Further, the First Formant in speech, which is the lowest resonance of the vocal tract, generally interferes with the estimation process, and sometimes produces misleading results. These misleading results must be corrected if the speech is to be resynthesised with good quality. Pitch estimation errors in speech have a highly damaging effect on reproduced speech quality, and methods of correcting such errors play a key part in rendering good subjective quality. Therefore, techniques which reduce the contribution of the First Formant and other secondary excitations to the pitch estimation method are widely sought.

Various methods are well known in the art to remove extraneous and misleading information from the speech signal so that the pitch estimation can proceed smoothly. However, even with the above methods, pitch error checking methods are still necessary to ensure a more robust estimation scheme. For example, the First Formant frequency in speech often occurs at frequencies where the period in samples, at an 8 KHz sampling rate, is less than 20 samples. Consequently, correlation peaks occurring in this range are generally ignored in the estimation process. However, this period also falls in the range of 21–30 samples regularly enough for one to be suspicious of any pitch values estimated to lie in this range. First Formant contributions in the correlation calculation, even where its effect has been mitigated by filtering methods described above, can still be strong. This can result in a situation where the First Formant frequency is incorrectly identified as the pitch.

Therefore, an improved vocoder system and method for performing pitch estimation and pitch estimation error checking is desired which more accurately estimates the pitch of a received waveform. An improved vocoder system and method is also desired which more accurately disregards the contribution of the First Formant and other secondary excitations to the pitch estimation method.

SUMMARY OF THE INVENTION

The present invention comprises an improved vocoder system and method for estimating pitch in a speech waveform. The vocoder system first performs a correlation calculation on a speech frame and generates an estimated or determined pitch value. The present invention then examines the estimated pitch from the correlation-based scheme for a suspiciously low pitch value in order to remove suspect values. The present invention performs error checking to disregard pitch estimates that are the result of the First Formant frequency's contribution to the pitch estimation process. This provides a more accurate pitch estimation, thus enhancing voice storage quality. The present invention thus comprises an improved correlation method for estimating the pitch parameter which more accurately disregards false correlation peaks resulting from secondary excitations, including the contribution of the First Formant.

In the preferred embodiment, the vocoder receives digital samples of a speech waveform wherein the speech waveform includes a plurality of frames each comprising a plurality of samples. The vocoder then performs a correlation calculation on a frame of the speech waveform to estimate the pitch of the frame. This correlation calculation produces one or more correlation peaks. The vocoder then performs any of various types of analysis to estimate the pitch of the frame, i.e., to determine a determined pitch value for the frame. The vocoder then determines if the determined pitch value is within a suspicious range. In the preferred embodiment, the vocoder determines if the determined pitch is less than a pitch threshold value.

If the determined pitch is less than the pitch threshold value, the vocoder performs error checking on the determined pitch value to determine if the determined pitch value should be accepted as the actual pitch value. The error checking principally comprises analyzing the higher multiples of the determined pitch value to determine if the higher pitch multiples are related by a common factor and also to determine if any multiples are missing.

In the preferred embodiment, the error checking comprises first dividing the peak locations determined in the correlation calculation by the determined pitch and rounding these computed values up to the nearest integer to produce an integer list. The vocoder then determines if the integer list contains a 1 value. If the integer 1 does not exist in the integer list, then a lowest pitch multiple missing routine is executed to find the low multiple, and operation completes. If the integer list does contain a 1 value and thus the lowest pitch multiple is present, then the vocoder determines if there are missing integers between the lowest and highest integers, i.e., between the number 1 and the highest integer. If there are no missing integers, then all multiples of the determined pitch are present, and the determined pitch is set as the true pitch.

If there are missing integers between 1 and the highest integer, then the determined pitch may not be the true or actual pitch. In this instance, the vocoder sets aside the lowest delay peak and determines if the remaining peaks are related by factors 2, 3, 5 or 7. In other words, the remaining integers are searched for common multiples, i.e., the vocoder determines if the remaining integers on the list have a common factor. If the remaining integers on the list other than the first multiple or "1" integer have a common factor, then it is likely that the first multiple is not the true pitch. If the remaining integers on the list do not have a common factor, then the determined pitch is accepted as the true pitch for the frame and operation completes.

If the remaining peaks do have a common factor, then it is likely that the low delay peak set aside earlier is a suspicious or false peak. The vocoder then determines which adjacent pitch multiples have missing correlation peaks. For each adjacent pair of multiples determined to have missing correlation peaks, the vocoder searches for low correlation peaks in a window around these missing multiples of the lowest delay correlation peak. Therefore, after the first multiple or integer has been discarded, where a factor exists relating the remaining peaks, and where a peak is missing between adjacent peaks, the present invention searches for correlation peaks corresponding to this missing multiple.

If a low correlation peak is detected in this search, and the low correlation peak is greater than a threshold, then the determined pitch is accepted as the true pitch, and operation completes. In this case, additional multiples of the original determined pitch are actually present, and thus the determined or candidate pitch is accepted as the true pitch.

If a low correlation peak of sufficient magnitude is determined to not exist in the neighborhood of any of the missing multiples, then the vocoder rejects the lowest correlation peak as the true pitch. The vocoder then determines if there is only one correlation peak left. If not, then the vocoder reanalyzes the remaining peaks to compute a new determined pitch as described above. The vocoder then repeats the above steps to ascertain if this new determined pitch is the true pitch. Thus the vocoder may perform several iterations of determining a pitch value and performing error checking before a determined pitch value is accepted as the true pitch. If the vocoder has already performed one or more iterations and determines that there is only one peak left, then the vocoder accepts this one remaining peak as the true pitch, and operation completes.

Therefore, the present invention more accurately provides the correct pitch parameter in response to a sampled speech waveform. More specifically, the present invention examines the multiples of the determined pitch to determine whether the determined pitch may be a result of the first Formant. This improves the pitch estimation process and more accurately mitigates the effects of the First Formant

BRIEF DESCRIPTION OF THE DRAWINGS

A better understanding of the present invention can be obtained when the following detailed description of the preferred embodiment is considered in conjunction with the following drawings, in which:

FIG. 10 illustrates operation of the pitch error checking method of the present invention, whereby

DETAILED DESCRIPTION OF THE PREFERRED EMBODIMENTS

Incorporation by Reference

The following references are hereby incorporated by reference.

For general information on speech coding, please see Rabiner and Schafer, *Digital Processing of Speech Signals*, Prentice Hall, 1978 which is hereby incorporated by reference in its entirety. Please also see Gersho and Gray, *Vector Quantization and Signal Compression*, Kluwer Academic Publishers, which is hereby incorporated by reference in its entirety.

Voice Storage and Retrieval System

Figure 1:
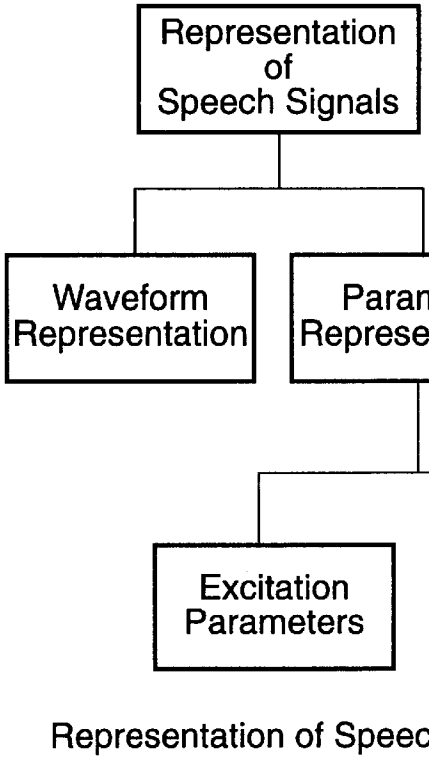
FIG. 1 (prior art)
FIG. 1 illustrates waveform representation and parametric representation methods used for representing speech signals.
Figure 2:
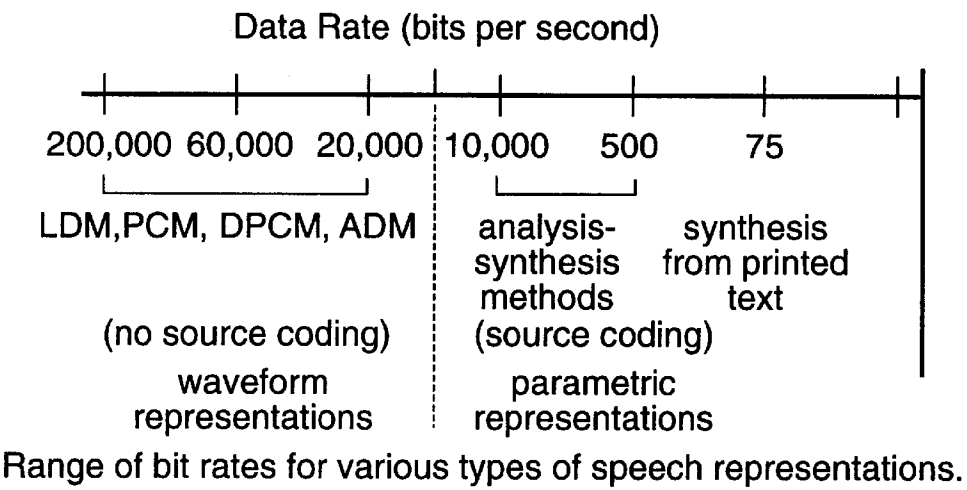
FIG. 2 (prior art)
FIG. 2 illustrates a range of bit rates for the speech representations illustrated in FIG. 1.
Figure 3:
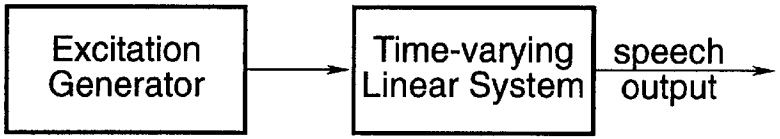
FIG. 3 (prior art)
FIG. 3 illustrates a basic model for speech production.
Figure 4:
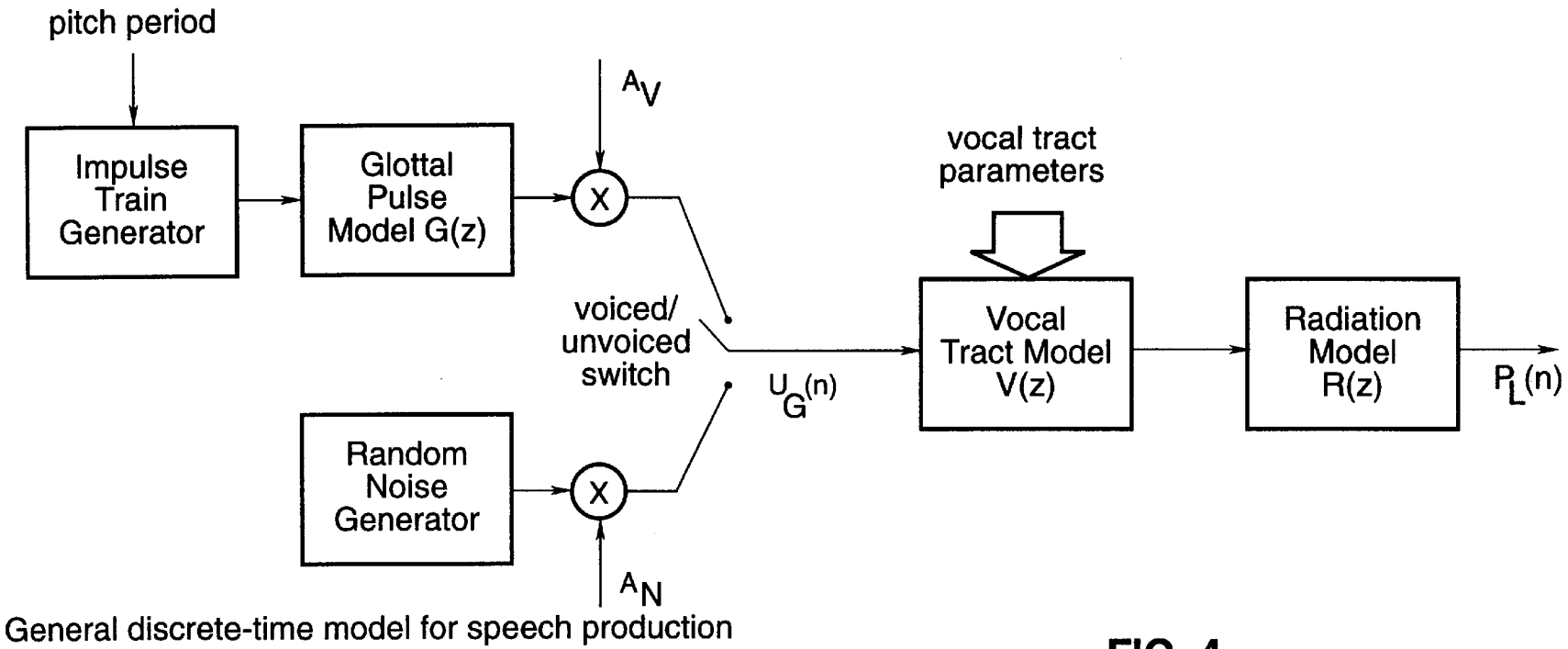
FIG. 4 (prior art)
FIG. 4 illustrates a generalized model for speech production.
Figure 5:
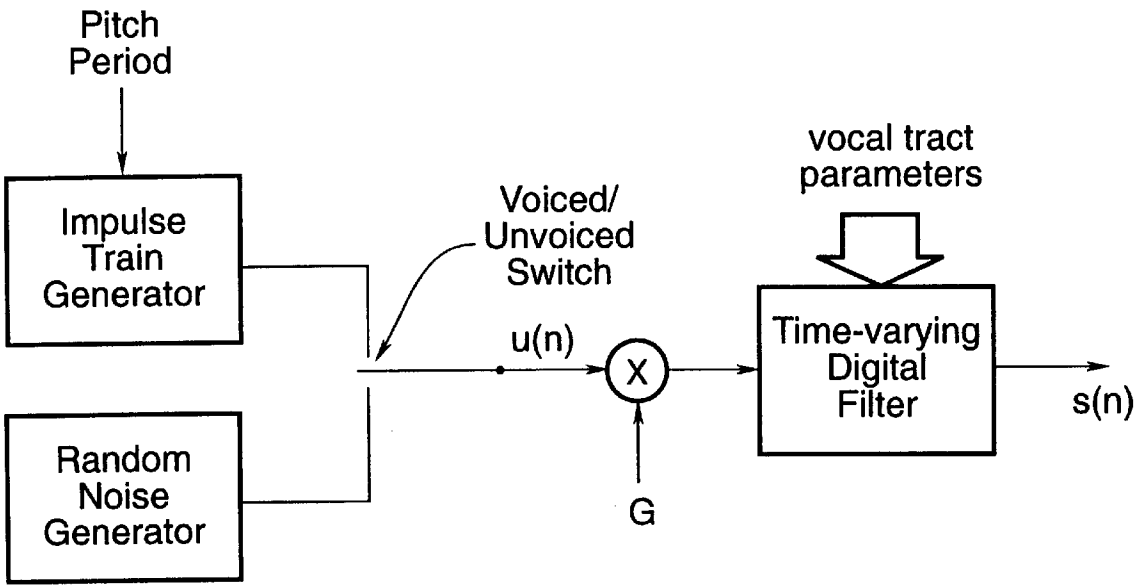
FIG. 5 (prior art)
FIG. 5 illustrates a model for speech production which includes a single time-varying digital filter.
Figure 6:
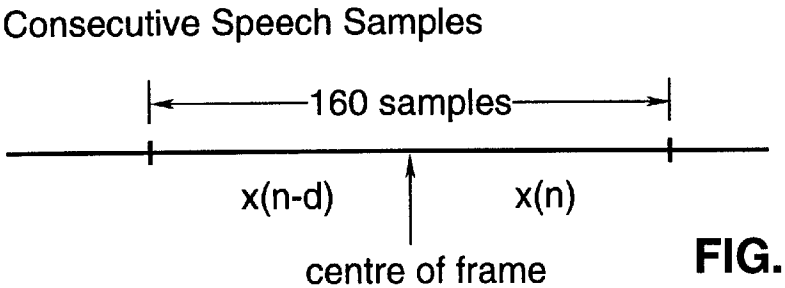
FIG. 6 illustrates a time domain correlation method for measuring the similarity of two sequences of digital speech samples.
Figure 7:
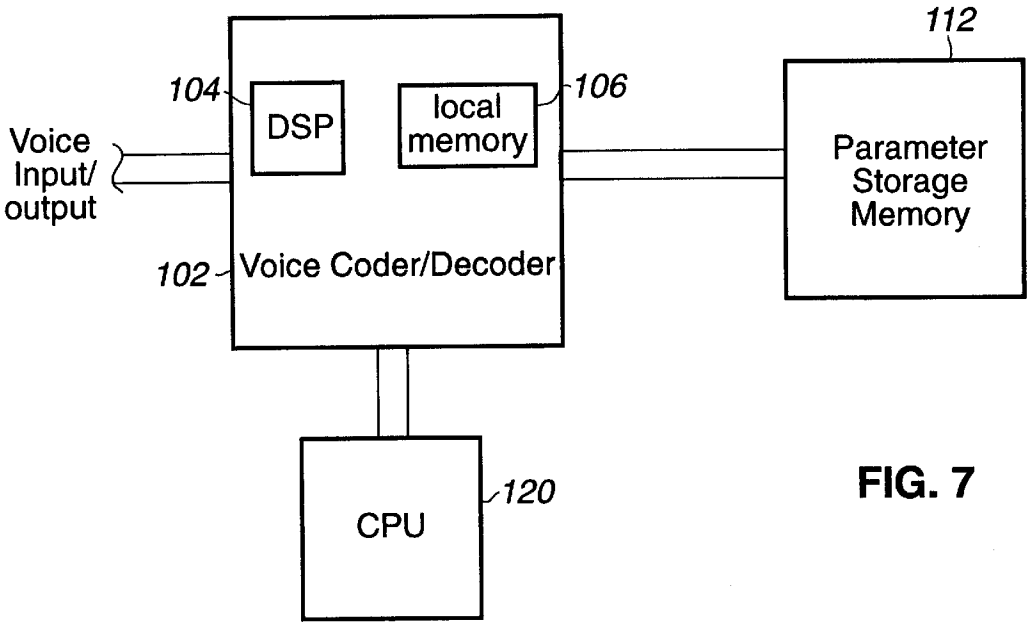
FIG. 7 is a block diagram of a speech storage system according to one embodiment of the present invention.

Referring now to FIG. 7, a block diagram illustrating a voice storage and retrieval system or vocoder according to one embodiment of the invention is shown. The voice storage and retrieval system shown in FIG. 7 can be used in various applications, including digital answering machines, digital voice mail systems, digital voice recorders, call servers, and other applications which require storage and retrieval of digital voice data. In the preferred embodiment, the voice storage and retrieval system is used in a digital answering machine.

As shown, the voice storage and retrieval system preferably includes a dedicated voice coder/decoder (codec) 102. The voice coder/decoder 102 preferably includes a digital signal processor (DSP) 104 and local DSP memory 106. The local memory 106 serves as an analysis memory used by the DSP 104 in performing voice coding and decoding functions, i.e., voice compression and decompression, as well as optional parameter data smoothing. The local memory 106 preferably operates at a speed equivalent to the DSP 104 and thus has a relatively fast access time.

The voice coder/decoder 102 is coupled to a parameter storage memory 112. The storage memory 112 is used for storing coded voice parameters corresponding to the received voice input signal. In one embodiment, the storage memory 112 is preferably low cost (slow) dynamic random access memory (DRAM). However, it is noted that the storage memory 112 may comprise other storage media, such as a magnetic disk, flash memory, or other suitable storage media. A CPU 120 is preferably coupled to the voice coder/decoder 102 and controls operations of the voice coder/decoder 102, including operations of the DSP 104 and the DSP local memory 106 within the voice coder/decoder 102. The CPU 120 also performs memory management functions for the voice coder/decoder 102 and the storage memory 112.

Alternate Embodiment

Figure 8:
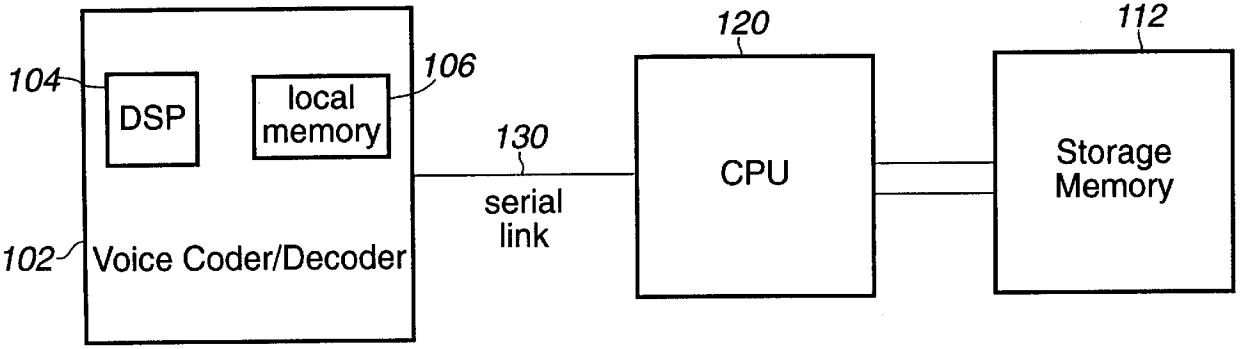
FIG. 8 is a block diagram of a speech storage system according to a second embodiment of the present invention.

Referring now to FIG. 8, an alternate embodiment of the voice storage and retrieval system is shown. Elements in FIG. 8 which correspond to elements in FIG. 7 have the same reference numerals for convenience. As shown, the voice coder/decoder 102 couples to the CPU 120 through a serial link 130. The CPU 120 in turn couples to the parameter storage memory 112 as shown. The serial link 130 may comprise a dumb serial bus which is only capable of providing data from the storage memory 112 in the order that the data is stored within the storage memory 112. Alternatively, the serial link 130 may be a demand serial link, where the DSP 104 controls the demand for parameters in the storage memory 112 and randomly accesses desired parameters in the storage memory 112 regardless of how the parameters are stored. The embodiment of FIG. 8 can also more closely resemble the embodiment of FIG. 7, whereby the voice coder/decoder 102 couples directly to the storage memory 112 via the serial link 130. In addition, a higher bandwidth bus, such as an 8-bit or 16-bit bus, may be coupled between the voice coder/decoder 102 and the CPU 120.

It is noted that the present invention may be incorporated into various types of voice processing systems having various types of configurations or architectures, and that the systems described above are representative only.

Encoding Voice Data

Figure 9:
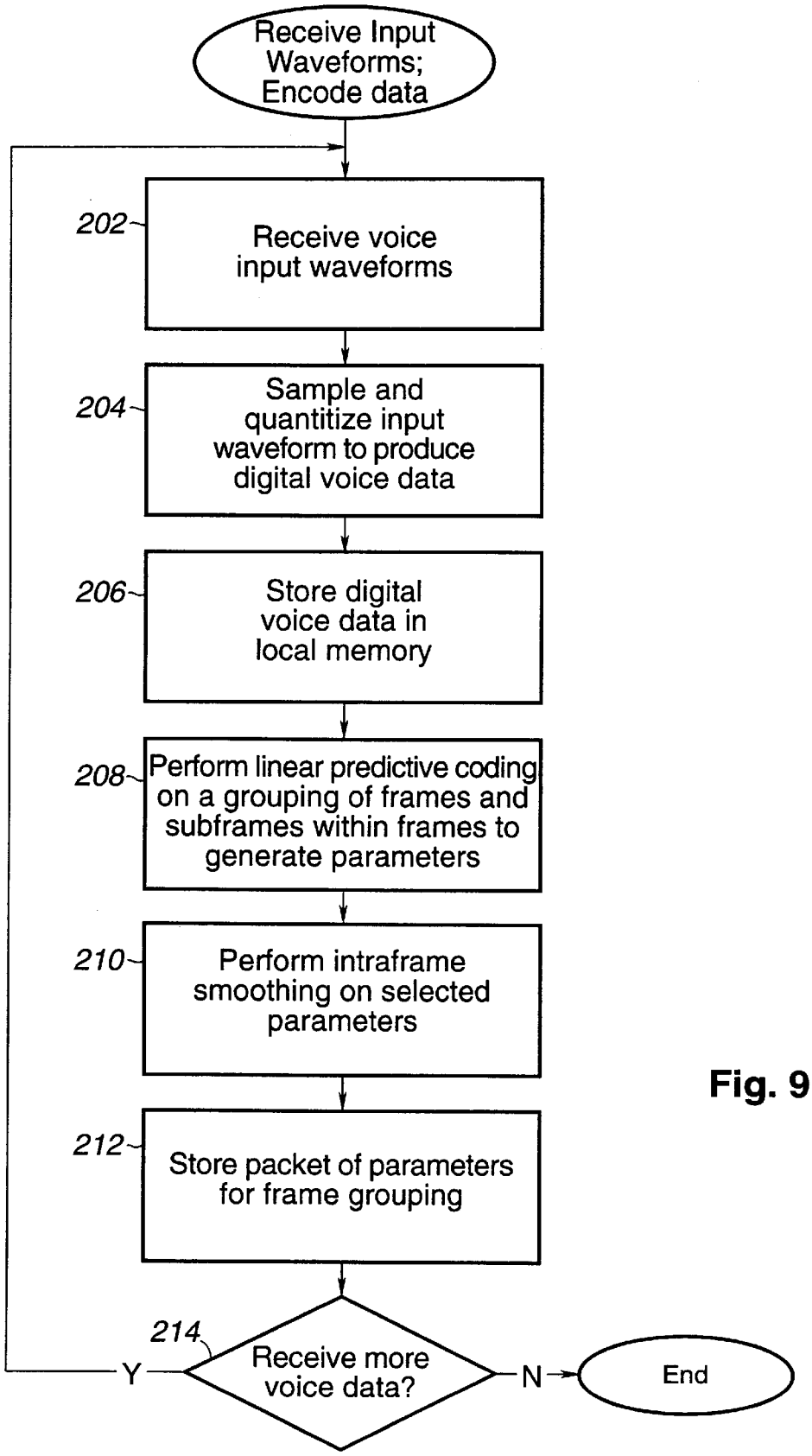
FIG. 9 is a flowchart diagram illustrating operation of speech signal encoding.

Referring now to FIG. 9, a flowchart diagram illustrating operation of the system of FIG. 7 encoding voice or speech signals into parametric data is shown. This figure illustrates one embodiment of how speech parameters are generated, and it is noted that various other methods may be used to generate the speech parameters using the present invention, as desired.

In step 202 the voice coder/decoder 102 receives voice input waveforms, which are analog waveforms corresponding to speech. In step 204 the DSP 104 samples and quantizes the input waveforms to produce digital voice data. The DSP 104 samples the input waveform according to a desired sampling rate. After sampling, the speech signal waveform is then quantized into digital values using a desired quantization method. In step 206 the DSP 104 stores the digital voice data or digital waveform values in the local memory 106 for analysis by the DSP 104.

While additional voice input data is being received, sampled, quantized, and stored in the local memory 106 in steps 202–206, the following steps are performed. In step 208 the DSP 104 performs encoding on a grouping of frames of the digital voice data to derive a set of parameters which describe the voice content of the respective frames being examined. Various types of coding methods, including linear predictive coding, may be used. It is noted that any of various types of coding methods may be used, as desired. For more information on digital processing and coding of speech signals, please see Rabiner and Schafer, *Digital Processing of Speech Signals*, Prentice Hall, 1978, which is hereby incorporated by reference in its entirety.

In step 208 the DSP 104 develops a set of parameters of different types for each frame of speech. The DSP 104 generates one or more parameters for each frame which represent the characteristics of the speech signal, including a pitch parameter, a voice/unvoice parameter, a gain parameter, a magnitude parameter, and a multi-based excitation parameter, among others. The DSP 104 may also generate other parameters for each frame or which span a grouping of multiple frames. The present invention includes a novel system and method for more accurately estimating the pitch parameter.

Once these parameters have been generated in step 208, in step 210 the DSP 104 optionally performs intraframe smoothing on selected parameters. In an embodiment where intraframe smoothing is performed, a plurality of parameters of the same type are generated for each frame in step 208. Intraframe smoothing is applied in step 210 to reduce these plurality of parameters of the same type to a single parameter of that type.

However, as noted above, the intraframe smoothing performed in step 210 is an optional step which may or may not be performed, as desired.

Once the coding has been performed on the respective grouping of frames to produce parameters in step 208, and any desired intraframe smoothing has been performed on selected parameters in step 210, the DSP 104 stores this packet of parameters in the storage memory 112 in step 212. If more speech waveform data is being received by the voice coder/decoder 102 in step 214, then operation returns to step 202, and steps 202–214 are repeated.

Example Waveform Illustrating Pitch Estimation

Figure 10A:
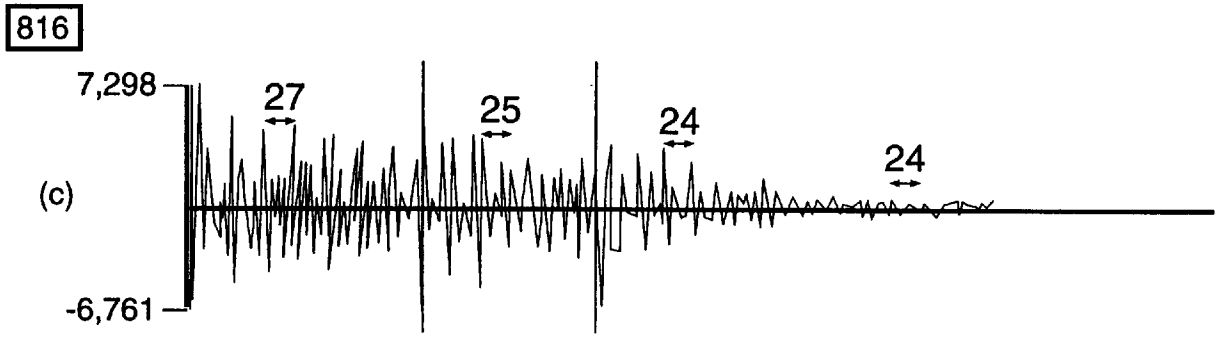
FIG. 10*a* illustrates a sample speech waveform.
Figure 10B:
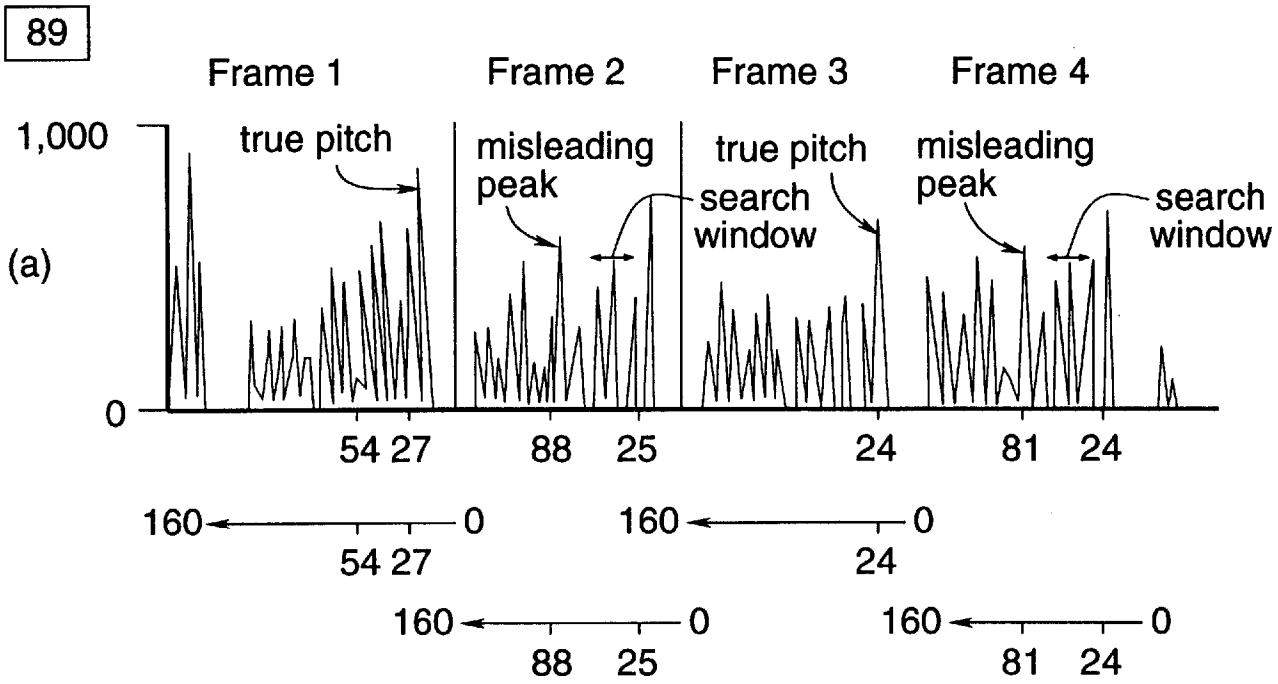
FIG. 10*b* illustrates a correlation output from the speech waveform of FIG. 10*a* using a frame size of 160 samples.
Figure 10C:
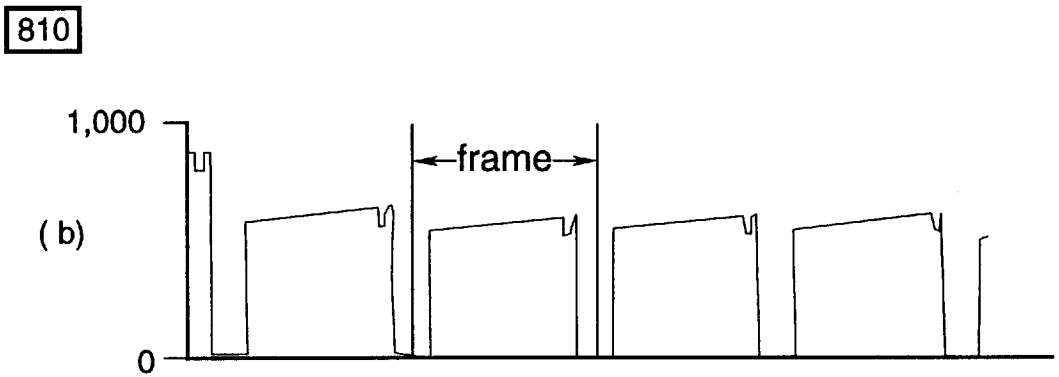
FIG. 10*c* illustrates the clipping threshold used to reduce the number of peaks in the estimation process.

FIG. 10 illustrates operation of a correlation-based pitch estimation method which includes missing pitch multiple error checking according to the present invention. FIG. 10*a* illustrates a sequence of speech samples where a transition from voiced to unvoiced speech is occurring. Examination of frames 1 to 4 shows that it is not always clearly apparent from the time domain waveform which excitation frequency is the dominant one. FIG. 10*b* illustrates the correlation results using equations 1, 2 and 3 described above with a frame size of 160 samples. As shown, several secondary excitation sources produce a clutter of peaks in the correlation functions of FIG. 10*b*. FIG. 10*c* shows the clipping threshold used to reduce the number of peaks used in the estimation process. The horizontal axes of FIGS. 10*b* and 10*c*, although not marked, are measured in delay samples for each individual frame, and vary from 0 to 160, going from right to left.

It is clear from examination of FIG. 10*b* that frame 1 includes a strong correlation peak at a delay of 27 samples. This is verified by FIG. 10*a*, where the time domain peaks are separated by 27 samples. A second multiple at 54 samples is above the clipping threshold, and thus 27 is the true pitch for that particular frame. However, examination of frame 2 in FIG. 10*a* shows that the time domain waveform is confused with secondary excitations, and two correlation peaks appear above the clipping threshold at delays of 25 and 88 samples respectively, as shown in FIG. 10*b*. Therefore, sample delays of either 25 or 88 are possible candidates for the true pitch.

Similarly, for frames 3 and 4, the correlation function produces a single peak above the clipping threshold at a sample delay of 24 for frame 3 and two peaks at sample delays of 24 and 81 in frame 4, respectively. The two peaks in frames 2 and 4, respectively, do not have an obvious relationship since they do not have an obvious common multiple. In this particular case, it might be assumed that the peaks at delays of 25 & 24 samples in frames 2 and 4, respectively, are the most likely candidates for the true pitch, given that frames 1 and 3 have pitches that are very close to 25 & 24, respectively. However, information about the pitch from a previous frame is not always available. When speech is transitioning from unvoiced to voiced, a previous frame may not contain any correlation peaks, thereby leaving a question regarding pitch peaks that have no common multiple. In this case, it is difficult to decide which peak is the true pitch.

The system and method of the present invention performs improved pitch error checking on low candidate pitches. The present invention uses information available in the correlation calculation to verify the validity of the pitch estimate. More particularly, the present invention examines the higher multiples of the determined or estimated pitch to determine if the pitch multiples are related by a common factor and also to determine if any pitch multiples are missing. The pitch error checking method of the present invention further searches for correlation peaks corresponding to missing multiples. If correlation peaks corresponding to the missing multiples cannot be found, the present invention disregards the current determined pitch and performs a new estimation.

FIG. 11—Robust Pitch Error Checking Method

Figure 11A:
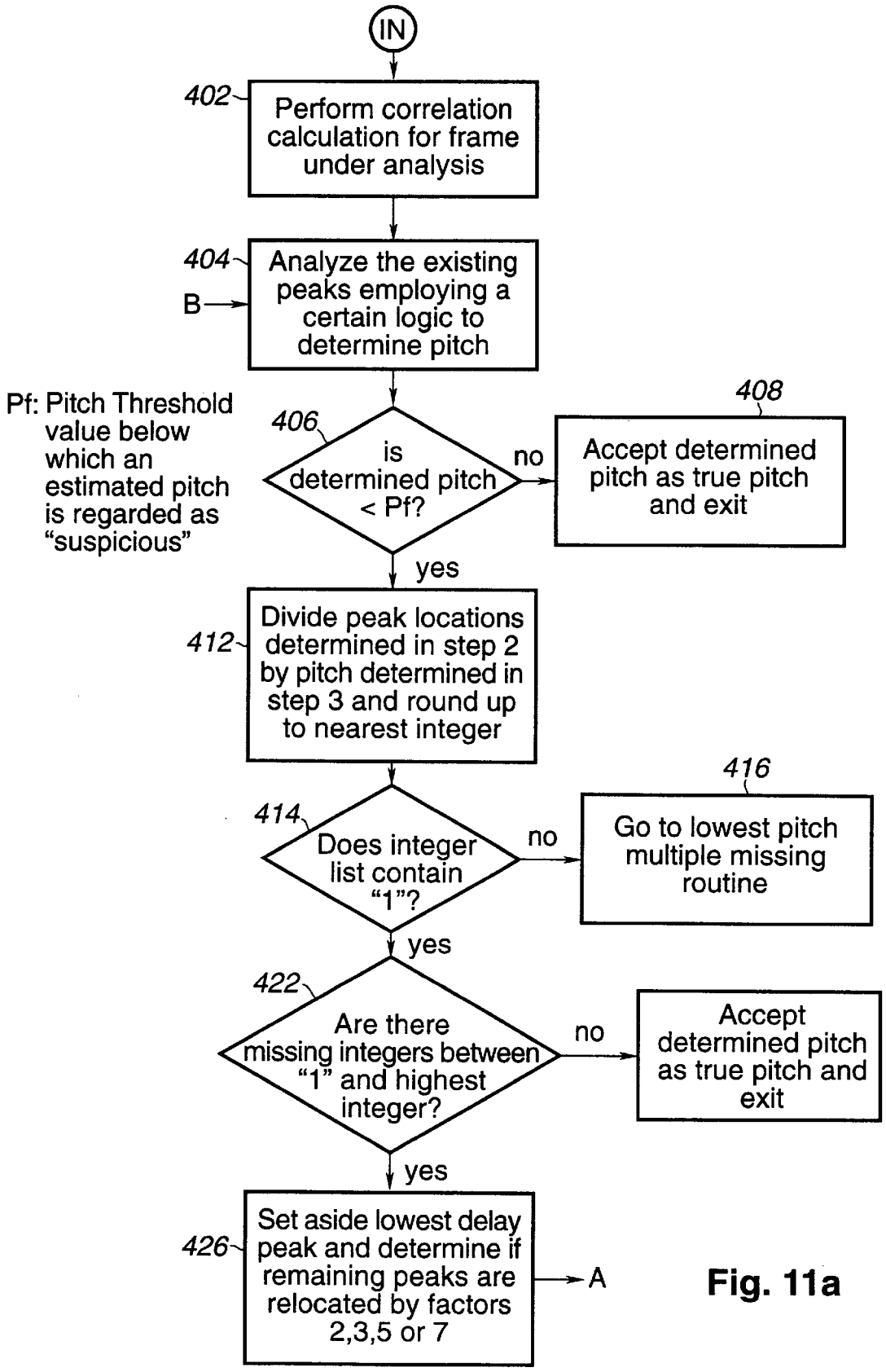
FIG. 11*a* and 11*b* are flowchart diagram illustrating operation of the pitch error checking method of the present invention.
Figure 11B:
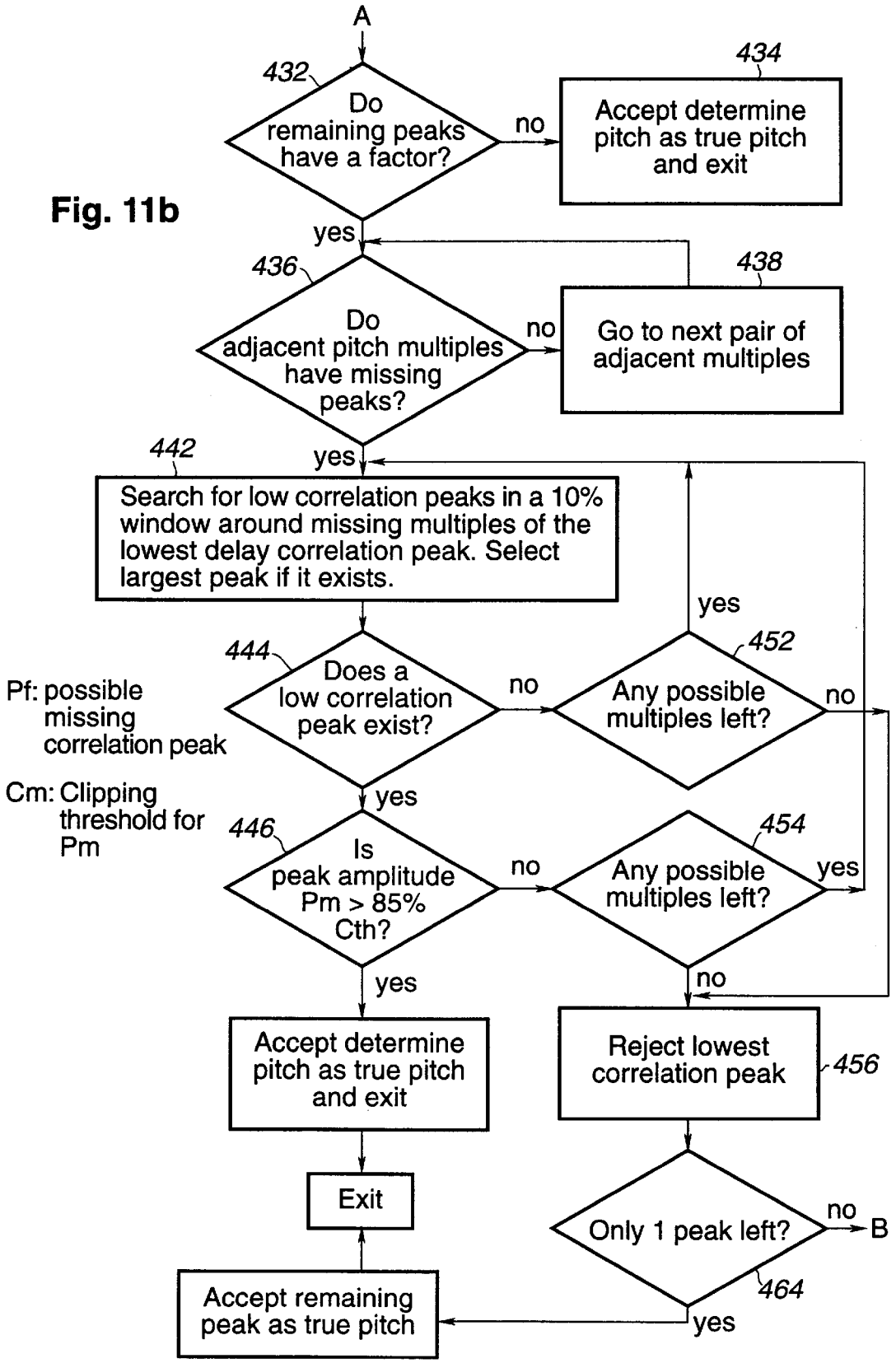

Referring now to FIG. 11, a flowchart diagram illustrating operation of the present invention is shown. FIG. 11 is shown in two figures referred to as FIG. 11*a* and 11*b* for convenience. In step 402 the vocoder performs a correlation calculation for the frame under analysis. The correlation calculation is performed using equations 1, 2 and 3 which were discussed above. The results of this correlation calculation are illustrated in FIG. 10*b*. It is noted that step 402 also performs clipping to remove erroneous peaks, i.e., to remove the "clutter" of peaks shown in FIG. 10*b*. In step 404 the vocoder analyzes the existing peaks to determine the pitch. In step 404, the existing peaks are analyzed employing any various desired methods to determine the pitch. The methods used to determine the pitch, in this step, i.e. to determine the optimum pitch from the remaining peaks, may be any of various types of methods. It is noted that the methods used to determine the optimum pitch may arrive at inaccurate results. After step 404, the vocoder has produced a pitch value which is referred to as the determined pitch or candidate pitch, also referred to as the first determined pitch value. It is noted that the determined pitch may or may not be the optimum or correct pitch value for the frame.

In step 406 the vocoder determines if the determined pitch is less than a pitch threshold value $P_f$. The threshold pitch value $P_f$ is a pitch threshold value, below which an estimated or determined pitch is regarded as suspicious. Thus, step 406 determines if the determined pitch in step 404 lies in a "suspicious" range. Referring now to FIG. 10, in the case of frame 2 of this example, the determined pitch value or candidate pitch value does lie in this suspicious frame, i.e., is less than the pitch threshold value. If the determined pitch is not below the pitch threshold value $P_f$, i.e., the determined pitch does not lie in the suspicious range, then in step 408 the determined pitch value is accepted as the true pitch value for the frame being examined and operation completes.

If the determined pitch value is less than the $P_f$, and thus lies within the suspicious range, then in step 412 the vocoder divides the peak locations determined in step 402 by the pitch value location determined in step 404 and rounds these computed values up to the nearest integer. The operation of step 412 is illustrated by the example of frame 2 in FIG. 10. Here it is assumed that in step 404 the vocoder determined that the determined pitch was 22 for frame 2. As discussed above, frame 2 of FIG. 10 includes peaks at 25 and 88 delay samples. Thus, operation of step 412 would result in integer values of 4 and 1 for the peaks in frame 2 of FIG. 10.

Upon completion of step 412, in step 414 the vocoder determines if the integer list generated in step 412 contains a 1 value. If an integer 1 does not exist in the integer list as a result of step 412, then in step 416 a lowest pitch multiple missing routine is executed. Thus, if the integer list does not contain a 1 value, then the lowest multiple of the pitch value, which is presumed to be the true pitch, is missing. Thus, in step 416 a routine is executed to recover from the situation, wherein this routine is designed to provide the lowest pitch multiple that has been determined to be missing. If the vocoder determines in step 414 that the integer list does contain a 1 value and thus the lowest pitch multiple is present, then operation advances to step 422.

In step 422 the vocoder determines if there are missing integers between the lowest and highest integers, i.e., between the number 1 and the highest integer. If there are no missing integers in step 422, then in step 424 the determined pitch is set as the true pitch for the frame and operation completes. If all of the integers are present between the lowest and highest integer, then this indicates that the determined pitch is the true pitch, since all multiples of the determined pitch are present. In this case, the determined pitch is set as the true pitch and operation completes.

If there are missing integers between 1 and the highest integer in step 422, then the determined pitch may not be the true or actual pitch. In the example of frame 2 used above, 1 and 4 are the integer values determined in step 412. Thus in this example it is apparent that the integers 2 and 3 are missing from the list. Thus, in the above example, this condition is met, i.e., there are missing integers between 1 and the highest integer. In this case where there are missing integers, in step 426 the vocoder sets aside the lowest delay peak and determines if the remaining peaks are related by factors 2, 3, 5 or 7. Thus, in step 426 the lowest delay peak, which is represented by the integer 1, is set aside and the remaining integers are searched for common multiples. After step 426, in step 432 (FIG. 11*b*) the vocoder determines if the remaining integers on the list have a common factor.

Steps 426 and 432 essentially test whether higher multiples of the determined pitch, which is the first multiple, have a common factor. If the remaining integers on the list do not have a common factor, then the determined pitch is accepted as the true pitch in step 434 and operation completes. If the remaining peaks do not have a common factor, then the determined pitch is presumed to not be a false or "rogue" pitch value, but rather is presumed to be an accurate estimate of the true pitch and is accepted as the true pitch, and operation completes. If the remaining integers on the list other than the first multiple or "1" integer have a common factor, then it is likely that the first multiple is not the true pitch. Thus, if the remaining peaks do have a common factor in step 432, then operation advances to step 436. In this instance, it is likely that the low delay peak set aside in step 426 is a suspicious or false peak.

In step 436 the vocoder searches for the adjacent pitch multiples that have missing peaks. In step 436 the set aside peak at integer value 1 is returned to the list, and pairs of adjacent multiples are searched for missing integers. If an adjacent pitch multiple being examined does not have missing peaks, i.e., a missing integer does not exist between the pair of adjacent integers being examined in step 436, then in step 438 the vocoder advances to the next pair of adjacent multiples, and operation then returns to step 436. Thus, steps 436 and 438 repeat until all pairs of adjacent multiples are searched for missing integers. It is noted that at least one pair of adjacent pitch multiples has missing peaks, since step 422 has previously determined that there were missing integers. Thus steps 436 and 438 are involved with finding the adjacent pairs of pitch multiples between which the missing peaks are located.

It is noted that various types of scenarios are possible in steps 426, 432 and 436. In the above example of frame 2 in FIG. 10, setting aside integer 1 in step 426 leaves the integer 4, which is a factor of both 2 and 4. In this example the correlation calculation produced only 2 peaks, with 2 missing peaks in between the two detected peaks. Thus, in this example, in step 432 the vocoder would determine that there is only one remaining peak. In this case where there is only one remaining peak in step 432, this is deemed equivalent to multiple remaining peaks having a common factor.

Another example is where step 412 has produced an integer list such as 4, 2 and 1. In this case, when integer 1 is set aside in step 426, the remaining integers 4 and 2 have a common factor 2 indicating that the low delay peak at integer 1 may be a "rogue" or false peak. In this case, step 436 would find no missing integers between 1 and 2, but would find a missing integer between integer 2 and 4, namely 3. The vocoder would then search for this missing correlation peak at the multiple location corresponding to integer 3 in step 442.

Several other combinations have been detected in experiments such as (5,4,1), (6,4,1), etc. These possibilities are taken into account in steps 432 and 436 to ensure that, where a factor exists relating the remaining peaks, and where a peak is missing between adjacent peaks, the situation is detected and acted upon accordingly.

As discussed above, the vocoder determines which adjacent pitch multiples have missing peaks in steps 436 and 438, and the vocoder proceeds to step 442. In step 442 the vocoder conducts a search within a window, preferably a +/−10% window, around the positions of possible missing peaks. Therefore, after the first multiple or integer has been discarded, where a factor exists relating the remaining peaks, and where one or more peaks are missing between adjacent peaks, the present invention searches for these missing multiples. In the above example of frame 2 in FIG. 10, peaks at integers 1 and 4 exist, and thus peaks at integers 2 and 3 were missing from the list. Since integer "1" represents the peak at sample delay 25, in step 442 the vocoder searches first at position 50 +/−2.5, where 2.5 is rounded up to 3 since the peak delays are at integer values.

In step 444 the vocoder determines if a low correlation peak exists at the search position. If a low correlation peak is determined to exist in step 444, then in step 446 the vocoder determines if the peak amplitude of the detected low correlation peak is greater than a threshold value. In other words, in step 446 the vocoder determines if:

$$P_m > 85\%\ C_t$$

where $P_m$ is the possible missing correlation peak and $C_{th}$ is the clipping threshold for $P_m$. In the preferred embodiment, $C_{th}$ is dependent on the amount of energy in the current frame being examined. The 85% value is used to determine if the located missing peak is sufficiently close to the clipping threshold.

If the peak amplitude is greater than the threshold, then additional multiples of the original determined pitch are actually present. In this case, the determined or candidate pitch is accepted as the true pitch, and operation completes. It is noted that, if a single low correlation peak of a "missing" multiple is found to exist in step 444 and is greater than the threshold in step 446, then the vocoder does not search for low correlation peaks in other missing multiples, but rather in this case the determined pitch is accepted as the true pitch. In an alternate embodiment, the vocoder searches for and finds low correlation peaks in all of the missing multiples before accepting the determined pitch as the true pitch.

If a low correlation peak is determined to not exist in the neighborhood of the missing multiple in step 444, then in step 452 the vocoder determines if any other possible multiples are left. Likewise, if the peak amplitude of a discovered low correlation peak is not greater than the threshold, then in step 454 the vocoder determines if any other possible multiples are left. If other possible missing multiples are determined to remain in either steps 452 or 454, the vocoder returns to step 442 and performs a search for a low correlation peak in a window around another missing multiple. Therefore, for each adjacent pair of multiples determined to have missing peaks or multiples, the vocoder searches for correlation peaks corresponding to the missing multiples.

If no possible multiples remain in either step 452 or 454, i.e., the vocoder has already searched for low correlation peaks around all of the possible missing multiples, and has been unable to detect a low correlation peak at one of these multiples that is greater than the threshold, then in step 456 the vocoder rejects the lowest correlation peak as the true pitch. In step 464 the vocoder determines if there is only one peak left. If not, then the vocoder returns to step 404 and reanalyzes the remaining peaks to compute a new determined pitch. The vocoder then repeats the steps described above to ascertain if this new determined pitch is the true pitch. Thus here the vocoder repeats all of the above steps using the remaining correlation peaks, i.e., minus the discarded correlation peaks, for analysis. If the vocoder determines that there is only one peak left in step 464, then in step 466 the vocoder accepts this one remaining peak as the true pitch, and operation completes.

The search performed in step 442 is illustrated by the present example using frame 2 of FIG. 10. As discussed above, the example being used produced correlation peaks at integers 1 and 4, and thus missing multiples at integers 2 and 3. As shown, the search window is illustrated in frame 2 at FIG. 10*b* for the missing multiple 2. In this example, a low correlation peak is found to exist within the window of the missing multiple, i.e., in the present example, a peak is discovered at sample delay 50. Thus, in this example, a low correlation peak is found to exist, and the peak amplitude is then compared against the threshold in step 446. In step 446 the vocoder compares the level of the peak "$P_m$", in question to the clipping threshold used for that peak, "$C_{th}$". In the present example, the peak amplitude of the low correlation peak is determined to be more than 85% of the assigned clipping threshold in step 446, and thus the original determined pitch is accepted as the true pitch.

If a low correlation peak were not found in step 444, then in step 452 the vocoder would determine in step 452 if other possible multiples remain. Alternatively, if a low correlation peak had been found but the peak was not greater than the clipping threshold in step 446, then the vocoder would determine in step 454 if other possible multiples remain. In the present example, if a low correlation peak were not found at integer 2, the vocoder would determine in either steps 452 or 454 that another possible multiple remained at integer 3, and thus a search should be made for a peak at this missing multiple. In the example, a search for a multiple corresponding to integer 3 involves searching for a possible peak at delay 75 +/−7.5 (rounded up to 8).

If there were also no correlation peak at integer 3, then since there are no multiples left, in step 456 the lowest correlation peak would be rejected as a "rogue" or false peak. In this case, since no missing peaks were found, no multiples of the lowest delay peak evidently exist, indicating strongly that the lowest delay peak is spurious.

After the lowest correlation peak is rejected in step 456, in step 464 the vocoder would determine if a single peak remains. If only one peak remains, the remaining peak is accepted as the true pitch in step 466, and operation completes. In this case, since no multiples of the lowest delay pitch were found, this low peak is rejected, and the remaining peak is determined as the best pitch candidate. If multiple peaks remain in step 464, then step 404 is re-entered and the above analysis is re-performed on the remaining peaks.

Performance

This method successfully checks the validity of the pitch estimates determined in frames 2 and 4 of FIG. 10*b*. Since the estimated pitches for frames 2 and 4 lie in the "suspicious" range, a search is made for possible missing peaks. This search is conducted once it has been determined that the lowest delay peak exists, there are possible missing peaks, and the remaining peaks other than the lowest delay peak have a common factor. The search windows are indicated in the region of a possible missing pitch multiple on FIG. 10*b* and, as can be seen, these peaks exist and are only just below the clipping thresholds allocated to these particular peaks.

Conclusion

Therefore, the present invention comprises an improved vocoder system and method for more accurately estimating the pitch parameter. The present invention comprises an improved correlation system and method for estimating and error checking the pitch parameter which more accurately disregards false correlation peaks resulting from secondary excitations and/or the contribution of the First Formant to the pitch estimation method. The present invention intelligently checks various criteria on suspiciously low peaks to determine if a low delay sample correlation peak is actually the true pitch.

Although the system and method of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

We claim:

1. A method for performing pitch error checking in a correlation-based pitch estimator, comprising:

receiving a speech waveform comprising a plurality of frames;

performing a correlation calculation for a first frame of said plurality of frames of said speech waveform, wherein said correlation calculation produces one or more correlation peaks;

determining a first determined pitch value for said first frame from said one or more correlation peaks, wherein said first determined pitch value corresponds to a first determined correlation peak;

determining if said first determined pitch value is less than a pitch threshold value;

setting said first determined pitch value as a pitch value for said first frame if said first determined pitch value is not less than said pitch threshold value;

performing error checking on said first determined pitch value to determine if said first determined pitch value should be set as the pitch value for said first frame if said first determined pitch value is less than said pitch threshold value, wherein said performing error checking includes determining if any pitch multiples of said first determined pitch value have missing correlation peaks; and determining a new determined pitch value for said first frame from at least a subset of said one or more correlation peaks, wherein said determining said new determined pitch value does not use said first determined correlation peak, wherein said determining said new determined pitch value is performed if any pitch multiples of said first determined pitch value have missing correlation peaks.

2. The method of claim 1, wherein said performing said error checking further comprises:

determining if said correlation peaks other than said first determined correlation peak have a common factor;

wherein said determining if any pitch multiples of said first determined pitch value have missing correlation peaks is performed if said peaks other than said first determined correlation peak have a common factor;

wherein said determining said new determined pitch value is performed if said peaks other than said first determined correlation peak have a common factor and if any pitch multiples of said first determined pitch value have missing correlation peaks.

3. The method of claim 2, wherein said one or more correlation peaks have correlation peak locations, wherein said determining if said correlation peaks other than said first determined correlation peak have a common factor comprises:

dividing said correlation peak locations of said one or more correlation peaks determined in said performing correlation calculations by said first determined pitch value to produce a plurality of integer values; and determining if said plurality of integer values are related by one or more common factors.

4. The method of claim 3, further comprising:

determining if said plurality of integer values contains a 1 value; and determining a lowest pitch multiple value of said first determined pitch value if said plurality of integer values does not contain a 1 value;

wherein said determining if said plurality of integer values are related by one or more common factors is performed only if said plurality of integer values contains a 1 value.

5. The method of claim 4, further comprising:

determining if there are missing integers between 1 and the highest integer in said plurality of integer values after determining said plurality of integer values; and setting said first determined pitch value as said pitch value for said first frame if there are no missing integers between 1 and the highest integer in said plurality of integer values;

wherein said determining if said plurality of integer values are related by one or more common factors is performed only if there are missing integers between 1 and the highest integer in said plurality of integer values.

6. The method of claim 1, wherein said performing said error checking further comprises:

searching for a correlation peak at one or more pitch multiples of said first determined pitch value which have missing correlation peaks in response to determining that one or more pitch multiples of said first determined pitch value have missing correlation peaks;

setting said first determined pitch value as said pitch value for said first frame if a correlation peak exists at one or more of said pitch multiples of said first determined pitch value which have missing correlation peaks.

7. The method of claim 6, wherein said searching for a correlation peak at one or more pitch multiples of said first determined pitch value which have missing correlation peaks comprises:

determining if a correlation peak exists at one or more of said pitch multiples of said first determined pitch value which have missing correlation peaks; and comparing said correlation peak at a pitch multiple of said first determined pitch value which has a missing correlation peak with a threshold value.

8. The method of claim 6, wherein said determining if a correlation peak exists at one or more of said pitch multiples of said first determined pitch value which have missing correlation peaks comprises determining if a correlation peak exists within a window of said one or more of said pitch multiples of said first determined pitch value which have missing correlation peaks.

9. The method of claim 6, further comprising:

rejecting said first determined pitch value if a correlation peak does not exist at said one or more pitch multiples of said first determined pitch value which have missing correlation peaks.

10. The method of claim 1, further comprising:

setting said first determined pitch value as said pitch value for said first frame if said if none of said pitch multiples of said first determined pitch value have missing correlation peaks.

11. The method of claim 10, wherein said steps of determining a first determined pitch value for said first frame from said one or more correlation peaks, determining if said first determined pitch value is less than a pitch threshold value, setting said first determined pitch value as said pitch value for said first frame if said first determined pitch value is not less than said pitch threshold value, performing error checking on said determined pitch value, determining a new determined pitch value for said frame, and setting said first determined pitch value as said pitch value for said first frame if said if none of said pitch multiples of said first determined pitch value have missing correlation peaks are performed a plurality of times until one of said determined pitch values is set as said pitch value for said first frame.

12. A method for performing pitch error checking in a correlation-based pitch estimator, comprising:

receiving a speech waveform comprising a plurality of frames;

performing a correlation calculation for a first frame of said plurality of frames of said speech waveform, wherein said correlation calculation produces one or more correlation peaks;

determining a first determined pitch value for said first frame from said one or more correlation peaks, wherein said first determined pitch value corresponds to a determined correlation peak;

determining if said first determined pitch value is less than a pitch threshold value;

setting said first determined pitch value as a pitch value for said first frame if said first determined pitch value is not less than said pitch threshold value;

performing error checking on said first determined pitch value to determine if said first determined pitch value should be set to the pitch value of said first frame if said first determined pitch value is less than said pitch threshold value, wherein said performing error checking comprises:

determining if said correlation peaks other than said determined correlation peak have a common factor; and determining if any pitch multiples of said first determined pitch value have missing correlation peaks if said peaks other than said determined correlation peak have a common factor; and determining a new determined pitch value for said first frame from a subset of said one or more correlation peaks, wherein said determining said new determined pitch value does not use said determined correlation peak, wherein said determining said new determined pitch value is performed if said correlation peaks other than said determined correlation peak have a common factor and if any pitch multiples of said first determined pitch value have missing correlation peaks.

13. A method for performing pitch error checking in a correlation-based pitch estimator, comprising:

receiving a speech waveform comprising a plurality of frames;

performing a correlation calculation for a first frame of said plurality of frames of said speech waveform, wherein said correlation calculation produces one or more correlation peaks;

determining a first determined pitch value for said first frame from said one or more correlation peaks, wherein said first determined pitch value corresponds to a first determined correlation peak;

determining if said first determined pitch value is less than a pitch threshold value;

setting said first determined pitch value as a pitch value for said first frame if said first determined pitch value is not less than said pitch threshold value;

performing error checking on said first determined pitch value to determine if said first determined pitch value should be set as the pitch value for said first frame if said first determined pitch value is less than said pitch threshold value, wherein said performing error checking includes analyzing pitch multiples of said first determined pitch value; and determining a new determined pitch value for said first frame from at least a subset of said one or more correlation peaks if said analyzing said pitch multiples of said first determined pitch value indicates that said first determined pitch value may not be the correct pitch value of said first frame.

14. The method of claim 13, wherein said analyzing said pitch multiples of said first determined pitch value includes determining if any pitch multiples of said first determined pitch value have missing correlation peaks;

wherein one or more pitch multiples of said first determined pitch value having missing correlation peaks indicates that said first determined pitch value may not be the correct pitch value of said first frame.

15. The method of claim 14, wherein said performing said error checking further comprises:

determining if said correlation peaks other than said first determined correlation peak have a common factor;

wherein said determining if any pitch multiples of said first determined pitch value have missing correlation peaks is performed if said peaks other than said first determined correlation peak have a common factor;

wherein said determining said new determined pitch value is performed if said peaks other than said first determined correlation peak have a common factor and if any pitch multiples of said first determined pitch value have missing correlation peaks.

16. The method of claim 15, wherein said one or more correlation peaks have correlation peak locations, wherein said determining if said correlation peaks other than said first determined correlation peak have a common factor comprises:

dividing said correlation peak locations of said one or more correlation peaks determined in said performing correlation calculations by said first determined pitch value to produce a plurality of integer values; and determining if said plurality of integer values are related by one or more common factors.

17. A vocoder which performs pitch estimation and error checking, comprising:

means for receiving a plurality of digital samples of a speech waveform, wherein the speech waveform includes a plurality of frames each comprising a plurality of samples;

a processor for determining a pitch value for each of said frames, wherein said processor comprises:

means for performing a correlation calculation for a first frame of said plurality of frames of said speech waveform, wherein said correlation calculation produces one or more correlation peaks;

means for determining a first determined pitch value for said first frame from said one or more correlation peaks, wherein said first determined pitch value corresponds to a first determined correlation peak;

means for determining if said first determined pitch value is less than a pitch threshold value;

means for setting said first determined pitch value as a pitch value for said first frame if said first determined pitch value is not less than said pitch threshold value;

means for performing error checking on said first determined pitch value to determine if said first determined pitch value should be set as the pitch value for said first frame if said first determined pitch value is less than said pitch threshold value, wherein said means for performing error checking determines if any pitch multiples of said first determined pitch value have missing correlation peaks; and means for determining a new determined pitch value for said first frame from at least a subset of said one or more correlation peaks, wherein said means for determining a new determined pitch value does not use said first determined correlation peak, wherein said means for determining a new determined pitch value operates if any pitch multiples of said first determined pitch value have missing correlation peaks.

18. The vocoder of claim 17, wherein said means for performing error checking further comprises:

means for determining if said correlation peaks other than said first determined correlation peak have a common factor;

wherein said means for performing error checking operates if said peaks other than said first determined correlation peak have a common factor;

wherein said means for determining a new determined pitch value operates if said peaks other than said first determined correlation peak have a common factor and if any pitch multiples of said first determined pitch value have missing correlation peaks.

19. The vocoder of claim 18, wherein said one or more correlation peaks have correlation peak locations, wherein said means for performing error checking further comprises:

means for dividing said correlation peak locations of said one or more correlation peaks determined by said means for performing a correlation calculation by said first determined pitch value to produce a plurality of integer values; and means for determining if said plurality of integer values are related by one or more common factors.

* * * * *